United States Patent [19]

Frenzel et al.

[11] Patent Number: 4,893,482

[45] Date of Patent: Jan. 16, 1990

[54] WARP-KNITTING FABRIC WITH OBLIQUE AND DIAGONAL FILLING THREADS

[75] Inventors: Bertram Frenzel; Dietmar Grenzendorfer; Heinz Kemter; Wolfgang Wuensch; Peter Zeisberg, all of Karl-Marx-Stadt, Fed. Rep. of Germany

[73] Assignee: VEB Kombinat Textima, Karl-Marx-Stadt, German Democratic Rep.

[21] Appl. No.: 323,467

[22] Filed: Mar. 14, 1989

Related U.S. Application Data

[60] Division of Ser. No. 61,254, Jun. 10, 1987, Pat. No. 4,841,747, which is a continuation-in-part of Ser. No. 14,152, Feb. 12, 1987, which is a continuation of Ser. No. 559,116, Dec. 7, 1983, abandoned.

[30] Foreign Application Priority Data

Feb. 28, 1983 [DD] German Democratic Rep. ..... 2483026

[51] Int. Cl.[4] ..... D04B 7/12

[52] U.S. Cl. ..... 66/190; 66/192; 66/193; 66/196; 66/84 A

[58] Field of Search ..... 66/84 A, 85 A, 190–195, 66/203; 28/100, 101

[56] References Cited

U.S. PATENT DOCUMENTS

| | | | |
|---|---|---|---|
| 2,890,579 | 6/1959 | Mauersberger | 66/192 |
| 3,321,348 | 5/1967 | Rupp | 66/84 A |
| 3,422,511 | 1/1969 | Seguin | 28/101 |
| 3,573,151 | 3/1971 | Dawborn | 196/439 |
| 3,680,332 | 8/1972 | Bassist | 66/84 A |
| 3,756,893 | 9/1973 | Smith | 156/440 |
| 3,878,591 | 4/1975 | Jense | 28/100 |
| 3,950,583 | 4/1976 | Patior | 28/101 |
| 4,395,888 | 8/1983 | Wilkens | 66/84 A |
| 4,567,738 | 2/1986 | Hutson et al. | 66/85 A |

FOREIGN PATENT DOCUMENTS 45-33874 10/1970 Japan ..... 66/85 A

OTHER PUBLICATIONS

Bahlo, American Assoc. for Textile Technology, "New Fabrics without Weaving", 11/65.

*Primary Examiner*—Ronald Feldbaum
*Attorney, Agent, or Firm*—Jordan and Hamburg

[57] ABSTRACT

Warp knit fabrics, especially sewn-knitted fabrics, are produced by a method and apparatus whch results in single and multiple layer sloping fabrics having oblique and diagonal endless filling threads with respect to the boundary of the fabrics. Spaced-apart chain conveyors transport a plurality of filling-thread sections, each of which contains a plurality of endless filling threads, to a stitch-forming site. The plurality of filling-thread sections are held between and transported by the conveyors by a plurality of hooks in the conveyors. Filling thread sections are laid onto the hooks by at least one filling laying device having a guide means for laying the filling thread sections onto the hooks. The filling laying device, guided by a pair of guide rods adjustably positioned obliquely and diagonally with respect to the direction of transportation of the chain conveyors, moves back and forth between the chain conveyors obliquely and diagonally with respect to the direction of transportation of the chain conveyors so that the filling thread sections are laid onto the hooks at an oblique and diagonal angle to the boundary of the fabric. Depending on the number of filling laying devices utilized, and the oblique and diagonal movement of each, single and multiple sloping products are produced wherein filling thread sections within a layer lay parallel to each other or overlap each other at various angles, and different layers of the fabric have mutually-crossing filling thread sections disposed obliquely or perpendicularly to the boundary of the fabric as desired.

9 Claims, 6 Drawing Sheets

WARP-KNITTING FABRIC WITH OBLIQUE AND DIAGONAL FILLING THREADS

REFERENCE TO RELATED APPLICATIONS

This is a divisional application of U.S. Ser. No. 061,254, filed Jun. 10, 1987, now U.S. Pat. No. 4,841,747 which is a continuation-in-part application of U.S. Ser. No. 014,152, filed Feb. 12, 1987, which is continuation of U.S. Ser. No. 559,116, filed Dec. 7, 1983, now abandoned.

BACKGROUND OF THE INVENTION

The invention relates to a method for the production of a textile strip, by preparing and aftertreating an intermediate product, with the textile strip having long weft elements, especially long weft threads, provided diagonally to the strip length, intersecting one another, and connected by longitudinal rows of stitches.

Furthermore, the invention relates to a textile strip, produced according to the method of the invention, as well as to a device on a warp knitting machine, particularly a stitch knitting machine, having at least one movable weft laying device for working long weft elements or weft threads, which extend over the entire working width, into the textile strip.

The invention further relates to a warp-knitting machine, especially a sewing-knitting machine, a production method and a warp-knit fabric. The warp knit fabric may also be referred to as a sloping product. To connect weft elements with stitch forming warp threads, a warp knitting machine uses a conventional needle system.

A method is known for the production of thread knitted textile strips with diagonally running long weft threads on a warp knitting machine, as well as thread knitting machines which when being used, make it necessary to design the operative width of the weft laying device, so that the distance from the first to the last thread of the weft thread group to be placed corresponds to a one to three and a half time expansion of the working width of the machine (Japanese patent application No. 42-67693).

If zig-zag like long weft threads are to intersect at an angle of 90°, or if the angle between the weft threads and a fictitious straight line, extending at right angles to the edge of the fabric, is to be 45°, the operative width of the weft laying device (which corresponds to the width of the long weft thread group to be placed) is twice as long as the working width of the machine. If the angle, formed by the long weft threads with the fictitious straight line is 60°, then the operative width of the weft laying device has to be approximately mately three and a half times the working width. At a working width of 3.5 m, which is the customary width for thread knitting machines, the weft laying device would have to be more than 10 m wide, and correspondingly massive.

Such a weft laying device merely allows a relatively slow mode of operation, which in most cases is not economically justifiable.

The described method is accomplished by a weft laying device, which moves back and forth at right angles in relation to the length of the textile strip. The placed group of long weft threads is guided by two weft thread transport means, into which the long weft threads are hung in the direction of a stitch formation zone, at which point the weft threads join the warp threads, forming a textile strip.

Methods and equipment for the production of warp-knit fabrics or sewn-knitted single sloping products and double sloping products are also known.

For example, as disclosed in U.S. Pat. No. 4,567,738, FIGS. 1 to 4, a single sloping product, comprising a group of filling threads, is produced owing to the fact that a single product with filling threads, which originally are at right angles to the longitudinal axis of the product, are distorted obliquely in an additional production step, to bring about an oblique adjustment of the filling threads relative to the longitudinal axis.

A double sloping product of two groups of filling threads can be produced according to this method by obliquely distorting two single products having filling threads, which are originally at right angles to the product, in separate production steps and subsequently combining them with one another in the nature of warp-knitting or sewn-knitting in yet another production step. At the same time, the single sloping products formed are placed next to one another in such a manner, that the oblique filling threads cross each other. If an additional linear assemblage of fibers is supplied to the two single sloping products before the latter are combined, the double sloping product will have a third structure axis, which is woven on during the process of combining the single sloping products. Because of the separate production of the single sloping products with filling threads originally at right angles and the subsequent treatment of these products, the method is relatively expensive.

A further known method and the equipment associated therewith (U.S. Pat. No. 4,567,738, FIGS. 5, 6 and 11, and Japanese Patent Application No. 42-67 693) start out from the idea of producing a warp-knitted or sewn-knitted single sloping product directly, without previously making a single product with filling threads originally at right angles in a separate production process. The method is carried out with a filling laying device, which moves back and forth at right angles to the length of the single sloping product. The laid group of filling threads is guided by two filling-thread transporting means, in which the filling threads are suspended, into a stitch-forming location, where the filling threads are combined with stitch-forming warp threads.

If a rather large angle of slope of the filling threads is desired and the single sloping product is to have an essentially linear edge, it is necessary to design the effective width of the filling laying device in such a manner, that the distance between the first and the last thread of the filling-distance thread group to be laid is a very long distance, which may be appreciably longer than the working width of the machine. Accordingly, if the filling threads, disposed in zigzag fashion, are to cross each other at an angle of 90°, or if the angle between the filling threads and an imaginary straight line, which extends at right angles to the edge of the fabric, is to amount to 45°, the effective width of the filling laying device (corresponding to the width of the group of filling threads that is to be laid) is twice as long as the working width of the machine. If the angle, which is formed by the filling threads with the imaginary straight line, is 60° effective width of the filling laying device must even be approximately three times the working width.

For a working width of 3.5 m, which is customary for relevant machines, the filling laying device alone would be more than 10 m wide and also correspondingly heavy. A filling laying device with an extended effective width and a corresponding structural size permits only a relatively slow mode of working, which is not economic in most cases.

SUMMARY OF THE INVENTION

It is an object of the invention to suggest additional methods for the production of symmetrical textile strips, which will additionally result in larger economical savings.

It is another object of the invention to produce a method and an apparatus for the production of a textile strip with essentially diagonally running long weft elements, especially long weft threads, making it possible to keep the heretofore used means for the laying of the weft threads over the entire width, maintaining them in their structural magnitudes and mechanical positions, and making them suitable for the intended purpose.

It is yet a further object of the invention to provide a warp-knitting and especially a sewing-knitting machine for the direct and inexpensive production of sloping products, which comprises at least one filling laying device, in which the distance from the first to the last thread of the filling-thread group to be laid (effective width of the filling laying device) is dimensioned substantially shorter than the working width of the machine.

A further object of the invention is to point out proposals for new warp-knit fabrics, especially sewn-knitting fabrics, which can be described as single, double or multiple sloping products, and for a method to produce the products.

The objects of the invention are accomplished by initially producing a strip of a weft and warp knit as an intermediate product, having long weft elements, particularly long weft threads, connected by stitches, by subsequently bringing the long weft threads into a very oblique position relative to the strip length, by diagonal displacement of the strip by the weft and warp knit, by doubling the weft and warp knit into two main layers, so that the oblique long weft threads of one main layer of the doubled material intersect the oblique long weft threads of the other main layer, and by finally fastening the two main layers of the doubled weft and warp knit with a top binding consisting of a number of rows of stitches running along the weft and warp knit.

A preferred embodiment of the textile strip, produced according to the method of the invention, consists of two main layers, each consisting of a basic binding with long weft threads connected thereto, with each basic binding having stitch loops on one side and connection stitches on the other side, with the main layers being connected to one another with a basic binding having shorter stitch loops, as well as with a smaller number of needles than is the case with other basic bindings of the main layers.

By means of a warp knitting machine, especially a thread knitting machine for the production of an intermediate product for the textile strip, produced according to the aforementioned method, with the weft laying device being diagonally movable back and forth between two transport chains, an intermediate product can represent the basis for the production of a textile strip, with its long weft threads having a very oblique position from the very beginning without having been diagonally displaced. If this initially very oblique position of the long weft threads is not oblique enough, an increasingly oblique position is achieved by minimal diagonal displacement.

The invention makes it possible to produce a textile strip, in which the oblique long weft threads of one main layer diagonally intersect the oblique long weft threads of the other main layer, without the magnitudes of the weft laying device, common in warp knitting machines, having to be replaced by means which would have to be oversized in dimensions.

The invention enables the effective width of a filling laying device of a warp-knitting machine to be dimensioned substantially shorter than the working width of the machine, while avoiding essentially nonlinear edges of the product. Accordingly, the size of the warp-knitting machine is reduced appreciably and the production speed can be increased.

By means of the warp-knitting machine of the present invention, the warp-knit fabric can be produced directly as an independent single sloping product with filling-thread sections laid obliquely, diagonally and in zigzag fashion or obliquely diagonally and parallel or as a double sloping fabric with two mutually crossing filling thread layers or as a multiple sloping product with several mutually crossing filling thread layers. Independent single sloping products can also be united together to produce a different type of double sloping product.

The invention also relates to the production of a double sloping product or of a multiple sloping product with filling thread layers, which do not cross over one another, the layers instead being parallel to one another. Furthermore, other thread assemblages or flat-shaped textile products may be added to all variations of the sloping products and tied into, or between the respective sloping products. Finally, each single, double or multiple sloping product may be furnished with at least one horizontal layer of filling threads.

The oblique and diagonal filling threads may or may not be disposed to conform to rows of stitches in such a manner, that there is a regular connection between the filling threads and the stitch-forming warp threads.

Thanks to the invention, the production of textile strips can be made much more cost efficient.

BRIEF DESCRIPTION OF THE DRAWINGS

The invention will be better understood by reference to the accompanying drawings, in which.

DETAILED DESCRIPTION OF THE PREFERRED EMBODIMENTS

Figure 1:
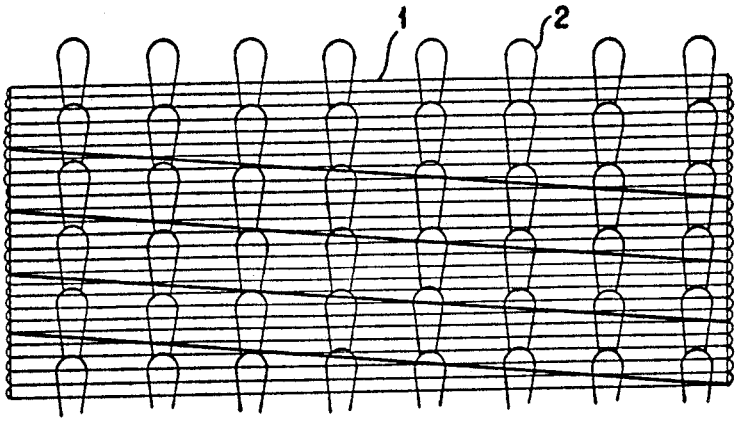
FIG. 1 shows a thread knitted weft and warp knit as intermediate product, with the long weft threads being arranged in a slightly oblique fashion.

FIG. 1 shows a weft and warp knit as intermediate product, constructed as thread knitted material. This thread knitted material consists of grouped zig-zag weft threads 1, which extend from one thread knitted fabric edge to the other in the form of long weft threads 1, and of a binding system 2, with which the long weft threads 1 are combined with a weft and warp knit. The long weft threads 1 are arranged in a slightly oblique fashion, and the binding system 2 can consist of any basic binding of warp knitted fabrics. Likewise, combinations of basic bindings can be used to combine the long weft threads 1. A weft and warp knit is furthermore suited as intermediate product for continued processing, with the long weft threads 1 being provided at a right angle to the knitted edges. The base material of the weft and warp knit can also consist of long weft elements 1, such as, for example, foil bands. The threads of the binding system 2 are made from materials which are as smooth and thin as possible, and the long weft threads 1 should be easily displaceable in the binding system 2.

The stitches of the binding system 2 are preferably formed rather long and loose, and the distance from a perpendicular row of stitches to a neighboring row of stitches preferably corresponds to a large number of needles.

The production of the weft and warp knit as intermediate product represents the first process step of the production of a textile strip according to the invention.

Figure 2:
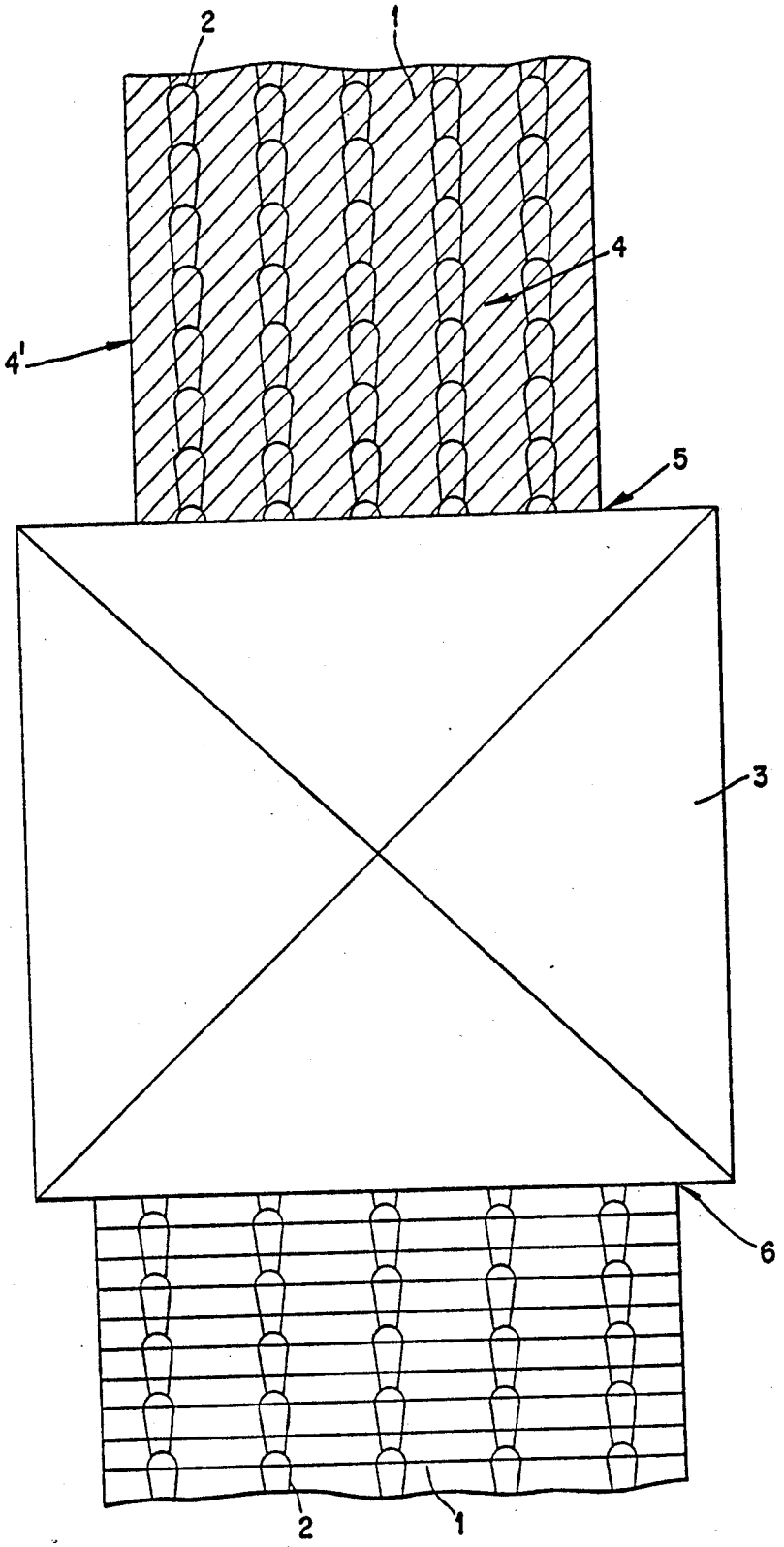
FIG. 2 is a diagram of the passage of a weft and warp knit through a machine in order to change the position of the long weft threads.

The intermediate product is subsequently supplied to a conventional machine 3 in order to change the position of the weft threads in woven fabrics (DD Pat. No. 183 987), which can also be used for the displacement of weft and warp knits (FIG. 2). The structure of a weft and warp knit is permanently changed by this machine 3 so that the weft threads or the long weft threads are placed in an oblique position 4 to the perpendicular rows of stitches of the binding system 2. Additionally, when the weft and warp knit is removed from the machine 3, the two thread systems of the weft and warp knit are in the changed postion 4' in relation to one another. This is achieved by two chains, grasping the weft and warp knit at the edges, with one chain, because of a special guidance of the same on the way to the working position 5 of the weft and warp knit, eventually remaining behind the other chain. Additionally, the distance between the two chains guided in one area is reduced since the chain distance at the exit point 5 has to be smaller than at the entrance point 6, because the width of the weft and warp knit decreases with an increasingly oblique positioning of the long weft threads 1.

The result of the passage of the weft and warp knit through the machine 3, according to Pat. No. DD-183 987, is a sheet, in which long weft threads 1 are subsequently brought into a markedly oblique angle, and which is narrower than the original width of the supplied weft and warp knit. The long weft threads 1 can, for example, be brought into such an oblique position that they form an angle of 45° or, for example, 60°, as compared to a right-angle long weft thread. Every desired angle of the long weft threads 1 can be set. The desired angle 1 of the long weft threads 1 can also be achieved gradually with several passages of the weft and warp knit through the machine 3, in order to change the position of the long weft thread 1. By linking the machine producing the intermediate product with the machine 3 producing the oblique position of the long weft threads 1, there results a synchronized working process.

Figure 3:
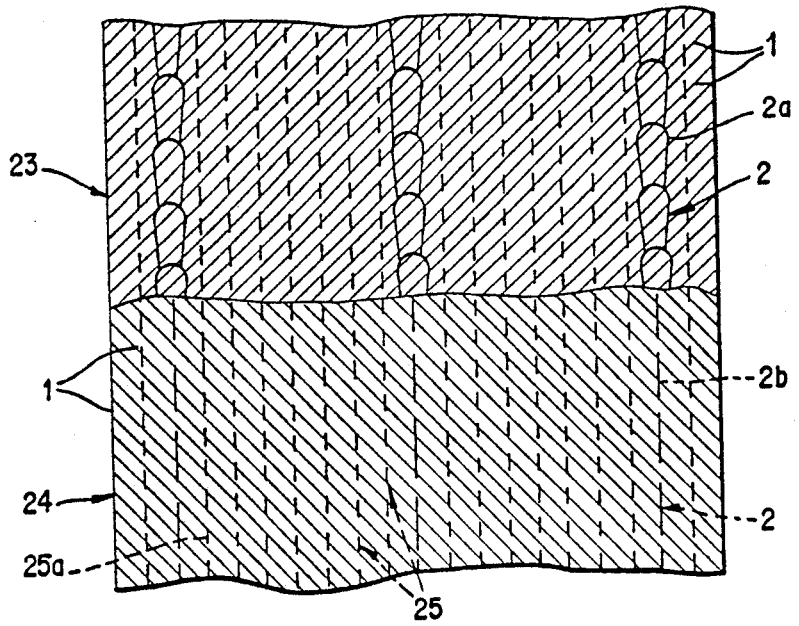
FIG. 3 is a schematic depiction of a section of a textile strip seen from one side, with both main layers of the textile strip being laid together, with the sides carrying the connection stitches of the basic binding, and with the connection stitches of the top binding being visible, as well as the stitch loops of the one basic binding on the top layer and the connection stitches of the other basic binding on the bottom layer.
Figure 4:
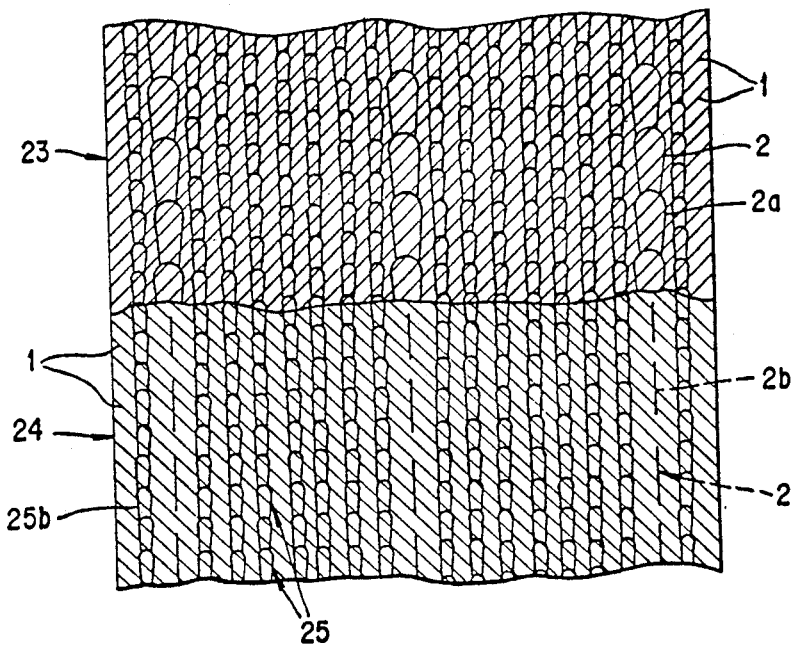
FIG. 4 is the same as FIG. 3, however, with the side of the textile strip being taken as a front view, showing stitch loops of the top binding, as well as the stitch loops of the one basic connection on the top layer, and the connection stitches of the other basic binding on the bottom layer.

According to FIG. 3, which shows a section of the textile strip, two unequally long pieces of the main layers 23;24 of the textile strip are sewn or stitched together. The one main layer 23 is the top layer 23 and the other main layer 24 the bottom layer 24. This generally applies for FIGS. 4 to 9 as well. Each main layer 23;24 consists of a weft and warp knit with diagonal long weft threads 1 and a binding system 2, representing the basic binding 2 for the textile strip. One speaks of main layers 23;24, because a weft and warp knit can in itself have several layers and a thread knitted material can, for example, be quasi two-layered. In the case of FIG. 3, both main layers 23;24, i.e., the top layer 23 and the bottom layer 24, have the same basic binding 2—a fringe binding—having stitch loops 2*a* on the one side of the textile strip and connection stitches 2*b* on the other side. For the purpose of producing textile goods which contain long weft threads and run diagonally to the strip length and essentially intersect one another diagonally, two main layers 23;24 were doubled by connecting them to one another, so that the angle of crossing of the long weft threads 1 of the main layers 23;24, located either above or below the horizontal line, is, for example, 120°. The doubling of the main layers 23;24 can be accomplished either by folding a strip of the weft and warp knit longitudinally, or by placing two separate strips next to one another.

Having described the production of the weft and warp knit having very oblique long weft threads 1, the following process steps have been described:

doubling of the strip of the weft and warp knit and connection of the two components of the doubled strip.

The connection system of the main layers 23;24 will be referred to as top binding. The top binding 25 comprises connection stitches 25*a* and stitch loops 25*b*.

In order to clarify FIG. 3, the top binding 25 has been merely provided between the perpendicular rows of the stitch loops 2*a* of the basic binding 2. In reality, there is a top binding 25 in the area of the basic binding 2 as well. The top binding 25 is a fringe binding. It is self-understood that other bindings can be used in lieu of the fringe binding. The stitch loops 2*a* of the basic binding 2 can be shorter or longer or equal to the stitch loops 25*b* of the top binding 25.

It is preferable that the stitch loops 2*a* in the basic binding 2 be relatively long, when the position of the long weft threads 1 is changed into an oblique position, after having produced the weft and warp knit, since the changed setting of the long weft threads 1 is then easier to achieve. The stitch loops 2*a* of the basic binding do not necessarily have to have the said length.

Figure 5:
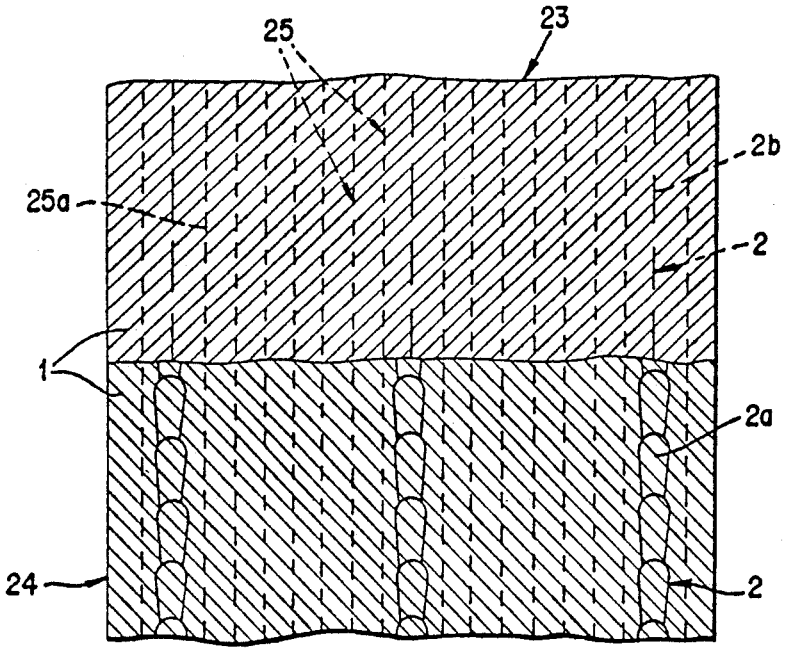
FIG. 5 is a schematic depiction of a section of a textile strip, taken from one side, with the two main layers of the textile strips with the sides having the stitch loops and the basic binding placed together, and with the connection stitches of the top binding, and the connection stitches of the one basic binding on the top layer, and the stitch loops of the other basic binding provided on the bottom layer.
Figure 6:
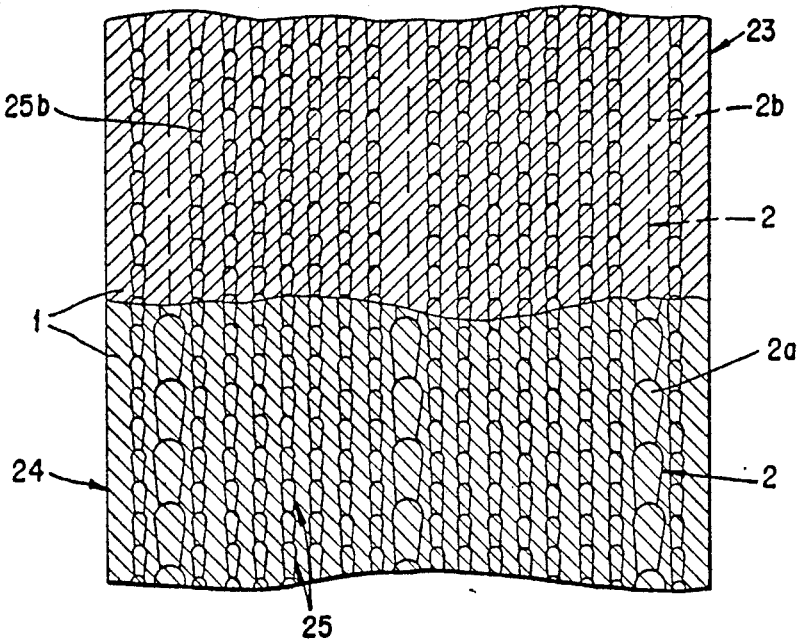
FIG. 6 is the same as FIG. 5, however, seen from one side of the textile strip, on which the stitch loops of the top binding can be seen, as well as the connection stitches of the basic binding on the top layer, and the stitch loops of the other basic binding on the bottom layer.

The section of the textile strip illustrated in FIG. 3 is furthermore characterized in that the main layers 23;24 are aced next to one another with the sides carrying the connection stitches 2*b* of the basic binding 2. This applies to the illustration in FIG. 4 as well. In contrast to FIG. 3, the side of the stitch loops 25*b* of the binding 25 was chosen as the front view. If one combines the main layers 23;24 with therein sides carrying the stitch loops 2*a* of the basic binding 2 the result is patterns, as shown in FIGS. 5 and 6. In these doubled variations,-the connection stitches 2*b* of the basic binding 2 are located on the top layers (main layers). All other characteristics of these patterns are analogous to FIGS. 3 and 4.

Figure 7:
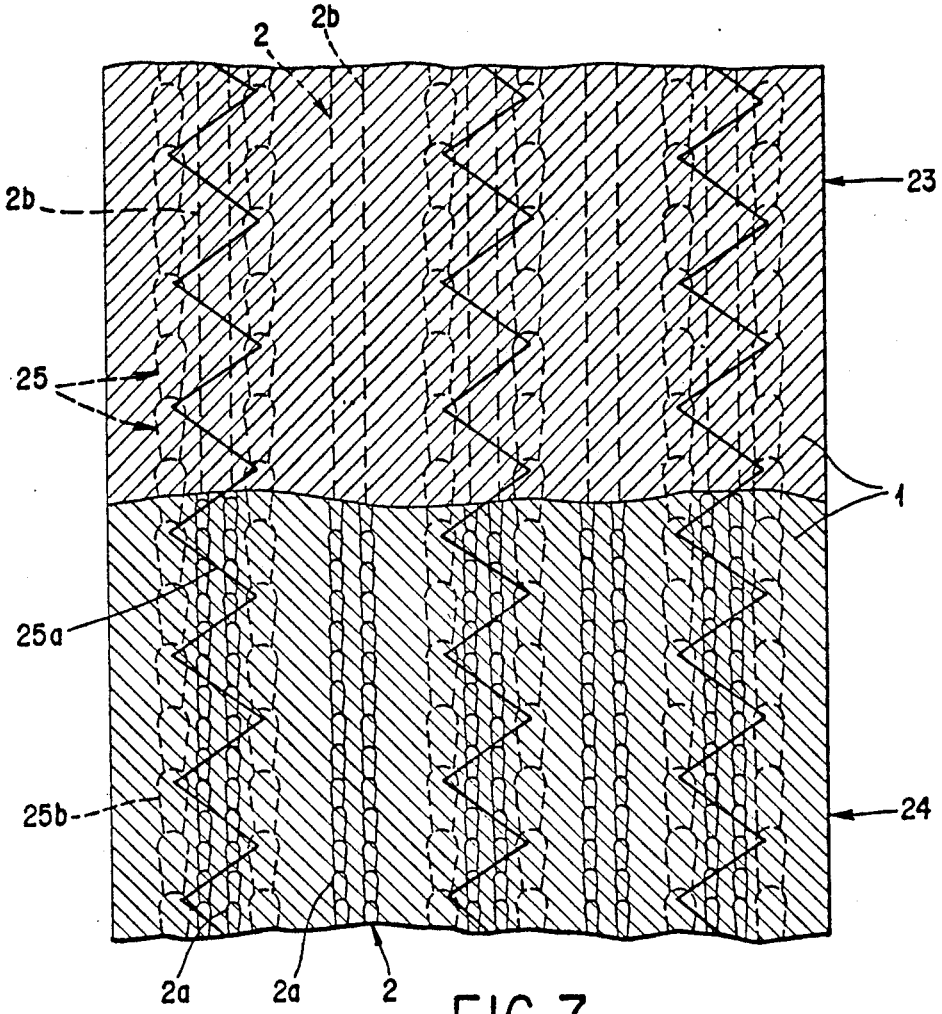
FIG. 7 is the same as FIG. 5, but with the top connection being a tricot connection with diagonal connection stitches, and with the basic binding of the two main layers of the textile strip consisting of smaller stitches than the top binding.

The pattern in FIG. 7 essentially corresponds to the pattern in FIG. 5, since the top layer 23 and the bottom layer 24 were laid next to one another, with the sides carrying the stitch loops 2*a* of the basic binding 2, and the front view shows the connection parts 25*a* of the top binding 25. The stitch loops 2*a* and the connection stitches 2*b* of the basic binding 2 are smaller than the stitch loops 25*b* and the connection stitched 25*a* of the top binding 25. Furthermore, a tricot binding is used instead of a fringe binding (FIGS. 3 to 6), in order to connect the top layer 23 and the bottom layer 24, or the two main layers 23;24. The stitch loops 25*b* are arranged on the bottom side of the illustrated pattern, and have been depicted by a dotted line.

Figure 8:
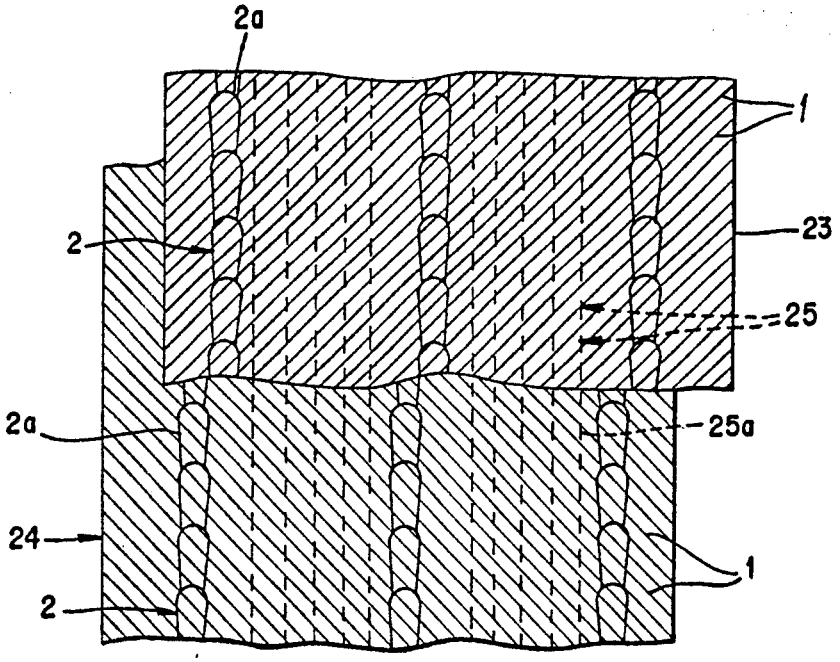
FIG. 8 is an additional schematic depiction of a section of a textile strip, in which the main layers are arranged with respect to one another in a staggered fashion, and placed adjacent to one another, so that the connection stitches of the basic binding of the one main layer and the stitch loops of the basic binding of the other main layer touch.
Figure 9:
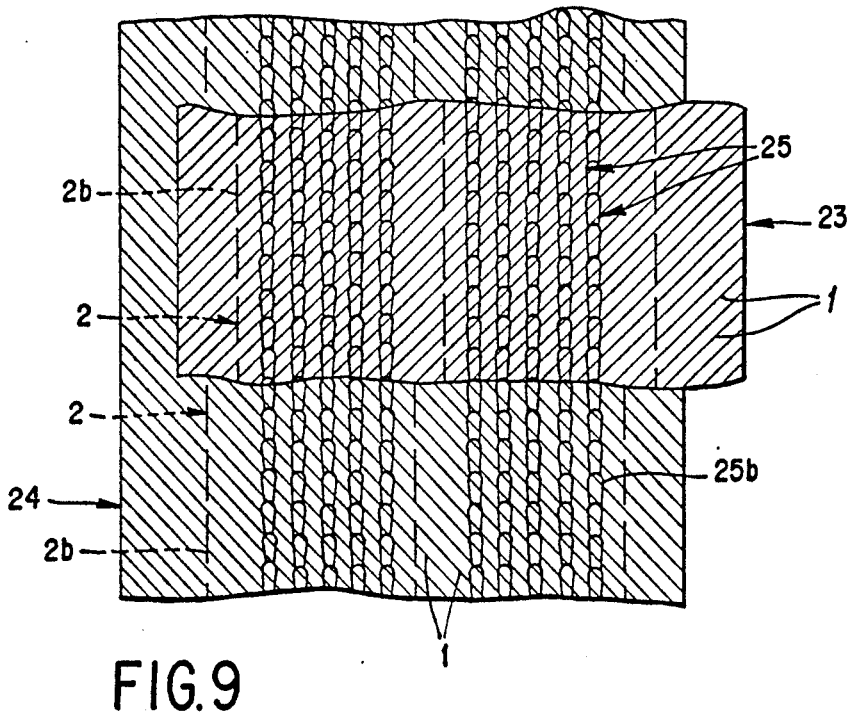
FIG. 9 is the same as FIG. 8, however, not looking at a side of the textile strip, which shows the connection stitches of the top binding, but at a side of the textile strip, which is provided with the stitch loops of the top binding.

FIGS. 8 and 9 illustrate how the textile strip is designed structurally when the stitch loops 2*a* of one of main layers 23;24 touch the connection stitches 2*b* of the other of main layers 23;24, following the doubling of the weft and warp knits. Addiionally, it can be noted that the main layers 23;24 are adjacent to one another in a displaced fashion, which is very common.

Furthermore, the textile strip can be produced from more than two main layers 23;24. It is possible to produce interlinings like sheets or warps, on or between the main layers 23;24.

The pattern variations shown in FIGS. 3 to 9 merely represent examples. Especially when changing the direction of the long weft threads 1 and the thickness, a number of additional patterns can be produced as well.

Figure 10:
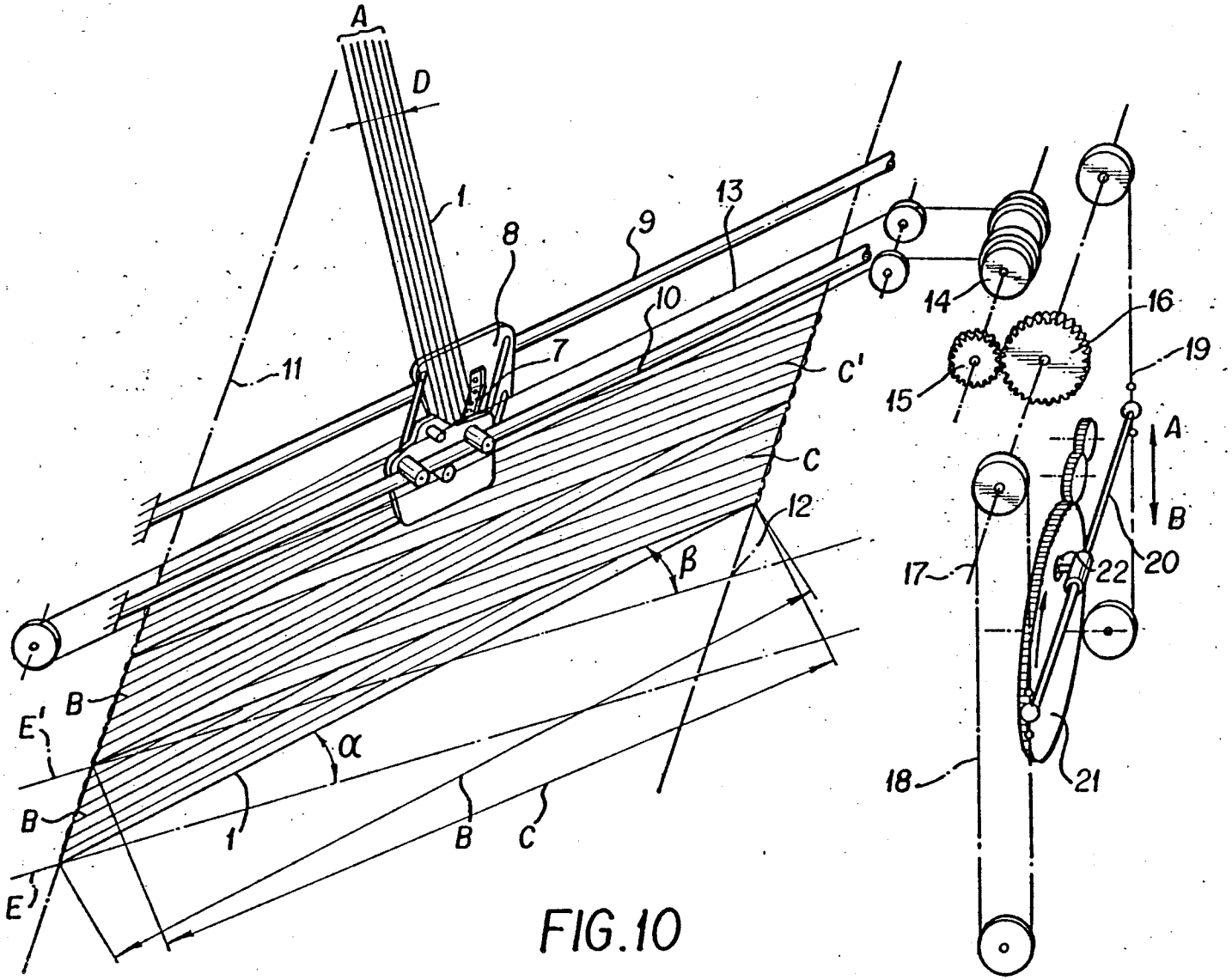
FIG. 10 is a perspective view of a portion of a warp-knit and especially of a sewing-knitting machine with a filling laying device, which moves back and forth obliquely and diagonally to two chain conveyors, an associated driving mechanism and obliquely and diagonally disposed filling-thread sections, which are processed further in a stitch-forming location to a warp-knit-fabric and especially to a sewn-knitted fabric, the sewn-knitted fabric representing an independent single sloping product.

Instead of using the machine 3 for changing the position of the weft threads, an intermediate product can be produced by a special thread knitting machine as well, as illustrated in FIG. 10. The thus produced intermediate product already initially has a very oblique position of the long weft threads 1.

As can be seen, the single sloping product or the sewn-knitted fabric originally already has an oblique layer of filling threads 1. Corresponding to FIG. 10, a filling laying device 8, equipped with a guiding means 7, moves back and forth obliquely between two hook-reinforced chain conveyors 11 and 12 for the purpose of producing this sewn-knitted fabric. In so doing, the filling threads 1, drawn into the filling laying device 8, are suspended as a thread assemblage in the hooks of the chain conveyors 11, 12 and conducted by these through the working location of the sewing-knitting machine. The sewing-knitting process then leads to the production of single sloping products, the filling threads 1 of which are fastened to one another by means of a binding thread system.

The oblique and diagonal position of the filling threads 1 is determined essentially by the adjustment of the guide rods 9, 10 in relation to the chain conveyors 11, 12. The angle of slope of the filling threads 1 is set by the angular setting of the guide rods 9, 10. The guiding means 7 for the filling threads 1 in the filling laying device 8 must be so designed, that it moves parallel to the conveyor chains 11, 12 at least at the sites of movement reversal of the filling laying device 8. Preferably, the filling laying device 8 has a rhomboidal shape.

In the example shown in FIG. 10, consecutive filling thread sections of filling threads 1, aside from being disposed at a sloping angle, are also slightly crossed. In practice, the crossing of the sequential filling-thread sections of the filling threads 1 is about 2° to 5°.

The filling thread layer of the single sloping product or the sewn-knitted fabric is actually formed from a sloping and diagonal zigzag arrangement of a filling thread group (filling threads 1), laid back and forth, the filling thread layer comprising individual, alternately provided filling thread sections of the filling thread group, and the filling thread sections forming different angles of slope with imaginary lines, which should run perpendicularly to the chain conveyors 11, 12. The filling thread sections of the filling thread group mutually overlap partially or cross over one another corresponding to the different angles of slope. Within each of the filling thread sections, the individual filling-thread segments lie parallel to one another.

The layer of filling threads (of the single sloping product or the sewn-knitted fabric) is clearly formed from a sloping or diagonal zigzag arrangement of a filling thread group laid back and forth, the layer of filling threads comprising individual alternately provided filling thread sections B and C of the filling-thread group, which have the group width D of the filling thread group, and the filling thread sections B and C forming different slope angles A and B. The vertices of the angles can be set on the chain conveyor 11. On the other hand, it is also possible to start out from angles, which have their vertices on chain conveyor 12, or from other angular relationships, which can be inferred from the representation of FIG. 10 with imaginary lines E, E', which run perpendicular to the chain conveyors 11, 12. Because of the perspective view of FIG. 10, the lines E, E′ appear to run obliquely in the drawing. Incidentally, the stitch-forming series of knitting needles at the workplace of the sewing-knitting machine runs parallel to the direction of lines E and E′. The horizontal series of stitches of the binding thread system also extend in the said direction. The filling thread sections B and C of the filling thread group partially overlap mutually or cross over one another slightly corresponding to the angles $\alpha$ and $\beta$.

If such a crossing is not desired, it is possible to follow the examples of U.S. Pat. Nos. 3,665,732 or 3,756,043. However, in this case, the guide rods for the filling laying device must also be inclined. The filling threads of the single sloping products, which can thus be produced, run parallel to one another and are not crossed in sections. The angle of slope of the filling threads is the same for all filling threads.

A second variation for an independent single sloping product with oblique and diagonal filling thread sections of the filling thread group is thus obtained. This variation differs from the previously treated variation in that the filling thread sections have the same angles of slope and do not mutually overlap. The filling thread sections are disposed consecutively and parallel to one another. The filling-thread segments within the filling-thread sections are also laid parallel to one another. All filling-thread segments are thus present at the same angle of slope.

The filling laying device 8 thus moves, in accordance with the oblique adjustment made, back and forth in this modified direction and, at the motion reversal sites, the thread-guiding means 7 moves, as before, once parallel to the chain conveyors 1, 2 and once in the direction opposite to their running direction. During the forwards and backwards travel of the filling laying device 8 between the chain conveyors 1, 2, the thread guiding means 7 must also, as in the past, carry out a component of motion in the running direction of chain conveyors 1, 2, in order to trail behind the previously laid section of the filling-thread group and to establish connection therewith. Expressed in a greatly simplified form, the thread guiding means 7 passes during each forward and backward travel of the filling laying device 8 through a path of motion, which corresponds to an eight, which lies obliquely as do the guide rods 8, 9. The filling layer formed is joined in the sewing knitting location by means of stitches to the single sloping product.

Single sloping products of the two variations described above may be used, for example, as reinforcing inserts in products where their stabilizing effect in the oblique direction of the filling threads is required.

By means of the invention, the possibility exists of producing warp-knit fabrics and especially sewn-knitted fabrics directly as double or multiple sloping products, without previously having to produce two or more independent single sloping products. The double or multiple sloping products moreover basically have the structures of the laid filling-thread sections of the single sloping products. For this purpose, several pairs of guide rods 9, 10 (the reference symbols of FIG. 10, mentioned at the start of the example of the operation, are used once again now) may be disposed consecutively, each with a filling laying device 8. Accordingly, if two pairs of guide rods 9, 10 are provided, which have different directions, a finished double sloping product with mutually crossing filling-threads 1, tied in obliquely to the fabric length, is obtained after passage of the two prepared layers or thread arrangements of filling-threads 1 through the working site of the sewing-knitting machine. In addition to the two pairs of guide rods 9, 10 mentioned, there exists the additional possibility of installing one or more pairs of guide rods 9, 10 with a filling laying device 8 at right angles between the chain conveyors 11, 12 in order to incorporate one or more other layers or thread arrangements of filling-threads 1, lying essentially at right angles, on and/or into the double sloping product.

It can be inferred longically from the examples described up till now that the sewn knitted fabric, other than as an independent single sloping product with filling-thread sections, laid obliquely, diagonally and zigzag-like or obliquely, diagonally and in parallel, can also be produced as a double sloping product with two mutually crossing filling-thread sections or as a multiple sloping product with several mutually crossing filling-thread layers.

It is also a question of producing a double sloping product or a multiple sloping product with filling-thread layers, which do not mutually cross but lie parallel to one another. Each single, double or multiple sloping product can be provided with at least one horizontal layer of filling threads.

The filling laying device 8 is driven by a mechanism corresponding to FIG. 10, in which a wirerope 13 is used, the upper strand of which is connected with the filling laying device 8. Both ends of the rope are attached to the rope drum 14, so that, as the rope drum 14 rotates in alternating directions one strand of the rope runs on to the drum 14, while the other runs off.

As a consequence of the connection between the filling laying device 8 and the wire rope 13, the filling laying device 8, as already mentioned above, moves back and forth between the two hook-reinforced chain conveyors 11, 12. The rope drum 14 obtains its alternating rotary motion from a shaft 17 over spur-toothed wheels 15, 16. The alternating rotational movement is imparted to the shaft 17 by two endless roller chains 18, 19, between which there is a lifting shaft 20. The ends of the lifting shaft 20 are coupled to the endless roller chains 18, 19. The lifting shaft 20, which is coupled eccentrically with a spur-toothed wheel 21 of relatively large diameter, is moved up and down as the spur-toothed wheel 21 moves in the directions A and B, as a result of which shaft 17 can be caused to rotate in alternating directions. The driving mechanism described thus has the construction and function of a Scotch-yoke mechanism.

If the back and forth motion of the filling laying device 8 is to be longer or shorter so as to change the working width of the sewing-knitting machine, the eccentric coupling of the crank pin 22 must either be brought closer to or removed further away from the center of motion of the spur-toothed wheel 21.

The crank pin 22 on the spur-toothed wheel 21 must also be adjusted when the oblique setting of the guide rods 9, 10 is changed, in order to take into account the change in the path of the filling laying device 8.

What we claim is:

1. A warp-knit fabric, and especially a sewn-knitted fabric, comprising a plurality of filling-thread sections disposed in zigzag fashion with respect to each other, each filling-thread section being composed of a plurality of endless filling threads arranged parallel to each other within a filling-thread section, the endless filling threads of a filling-thread section being arranged obliquely and diagonally with respect to a boundary of said fabric, each filling-thread section being arranged obliquely and diagonally with respect to the boundary of said fabric at a different angle of slope than another filling-thread section, whereby adjacent filling-thread sections overlap one another, said filling-thread sections being secured to each other by stitch-forming warp threads.

2. A warp-knit fabric, and especially a sewn-knitted fabric, comprising a plurality of filling-thread sections disposed in parallel to each other, each filling-thread section being composed of a plurality of endless filling threads arranged parallel to each other within a filling-thread section, the endless filling threads of a filling-thread section being arranged obliquely and diagonally with respect to a boundary of said fabric, all filling thread sections being arranged obliquely and diagonally at, the said angle of slope with respect to the boundary of said fabric, said filling thread sections being secured to each other by stitch-forming warp threads.

3. A warp-knit fabric, and especially a sewn-knitted fabric, comprising a first filling thread layer of a first plurality of filling-thread sections and a second filling thread layer of a second plurality of filling-sections, the first plurality of filling-thread sections mutually crossing the second plurality of filling-thread sections, each of the filling-thread sections of the first and second plurality of filling-thread sections comprising a plurality of endless filling-threads arranged parallel to each other within a filling-thread section, the endless filling threads of each filling with thread section being arranged obliquely and diagonally respect to a boundary of said fabric, the first and second filling-thread layers being combined by stitch-forming warp threads.

4. A warp knit fabric as in claim 3, wherein each of the first plurality of filling-thread sections is arranged obliquely and diagonally with respect to the boundary of said fabric at a different angle of slope than another of said first plurality of filling-thread sections, whereby adjacent filling-thread sections of said first plurality overlap one another in zig-zag fashion, and all of the second plurality of filling-thread sections are arranged obliquely and diagonally at the same angle of slope with respect to the boundary of said fabric.

5. A warp-knit fabric as in claim 3, further comprising a third filling thread layer of a third plurality of filling-thread sections, each of the filling-thread sections of the third plurality of filling-thread sections comprising a plurality of endless filling threads arranged parallel to each other and approximately perpendicularly to the boundary of the fabric, said first, second and third filling-thread layers being combined by stitch-forming warp-threads.

6. A warp knit fabric as in claim 5, wherein said third filling-thread layer is laid on top of said first and second filling thread layers.

7. A warp knit fabric as in claim 5, wherein said third filling-thread layer is between said first and second filling thread layers.

8. A warp knit fabric as in claim 5, further comprising a fourth filling-thread layer of a fourth plurality of filling-thread sections, each of the filling-thread sections of the fourth plurality of filling-thread sections comprising a plurality of endless filling-threads arranged parallel to each other and approximately perpendicularly to the boundary of the fabric, said first, second, third and fourth filling-thread layers being combined by stitch-forming warp threads.

9. A warp knit fabric as in claim 8, wherein said third filling-thread layer lays on top of said first and second filling-thread layers, and said fourth filling-thread layer lays between said first and second filling-thread layers.

* * * * *